US008087899B2

(12) United States Patent
Hsu

(10) Patent No.: US 8,087,899 B2
(45) Date of Patent: Jan. 3, 2012

(54) ELECTRIC FAN

(76) Inventor: Ching-Feng Hsu, Taipei Hsien (TW)

( * ) Notice: Subject to any disclaimer, the term of this patent is extended or adjusted under 35 U.S.C. 154(b) by 463 days.

(21) Appl. No.: 12/433,911

(22) Filed: May 1, 2009

(65) Prior Publication Data

US 2010/0278658 A1 Nov. 4, 2010

(51) Int. Cl.
*F03B 3/12* (2006.01)

(52) U.S. Cl. ..... 416/246; 416/244 R; 415/126

(58) Field of Classification Search ..... 416/244 R, 416/246; 415/126
See application file for complete search history.

(56) References Cited

U.S. PATENT DOCUMENTS 4,732,539 A * 3/1988 Shin-Chin ..... 416/100
5,429,481 A * 7/1995 Liu ..... 416/246
6,244,823 B1 * 6/2001 Marino et al. ..... 416/246

* cited by examiner

*Primary Examiner* — Zandra Smith
*Assistant Examiner* — Jamie C Niesz
(74) *Attorney, Agent, or Firm* — Pearne & Gordon LLP

(57) ABSTRACT

An electric fan has a driving assembly, a stand and an impeller assembly being connected to and being driven by the driving assembly. The driving assembly has a positioning panel having multiple indentations and two connectors being formed on the positioning panel. The stand is mounted into the driving assembly and around the connector of the driving assembly and has at least two resilient positioning protrusions engage two of the indentations of the driving assembly. With the at least two positioning protrusions engaging different indentations, the driving assembly and the impeller assembly are pivoted and are held in different angles. Therefore, the angle of the impeller assembly is easily adjusted.

6 Claims, 5 Drawing Sheets

ELECTRIC FAN

BACKGROUND OF THE INVENTION

1. Field of the Invention

The present invention relates to an electric fan, especially to an electric fan with an easily adjusted impeller assembly.

2. Description of the Prior Arts

An electric fan produces airflow and makes a draft. Especially in hot weather, the electric fan dissipates heat around people to make people feel comfortable.

A conventional electric fan has a stand, an impeller assembly, a connector and a bolt. The connector is attached to the impeller assembly and is mounted pivotally in the stand. The bolt is mounted through the stand and selectively fastens to the connector to hold the impeller assembly in a specific angle or loosens from the connector to allow the impeller assembly to pivot relative to the stand.

However, loosening the bolt to adjust the angle of the impeller assembly and fastening the bolt to hold the impeller assembly in the specific angle are inconvenient and time consuming. Moreover, connection between the connector and the bolt gradually wear away causing movement of the impeller assembly. Consequently, the impeller assembly is not held in specific positions when the connector and the bolt are worn down.

To overcome the shortcomings, the present invention provides an electric fan to mitigate or obviate the aforementioned problems.

SUMMARY OF THE INVENTION

The main objective of the present invention is to provide an easily adjusted electric fan.

The electric fan has a driving assembly, a stand and an impeller assembly being connected to and being driven by the driving assembly. The driving assembly has a positioning panel having multiple indentations and two connectors being formed on the positioning panel. The stand is mounted into the driving assembly and around the connector of the driving assembly and has at least two resilient positioning protrusions engage two of the indentations of the driving assembly.

With the at least two positioning protrusions engaging different indentations, the driving assembly and the impeller assembly are pivoted and are held in different angles. Therefore, the angle of the impeller assembly is easily adjusted.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
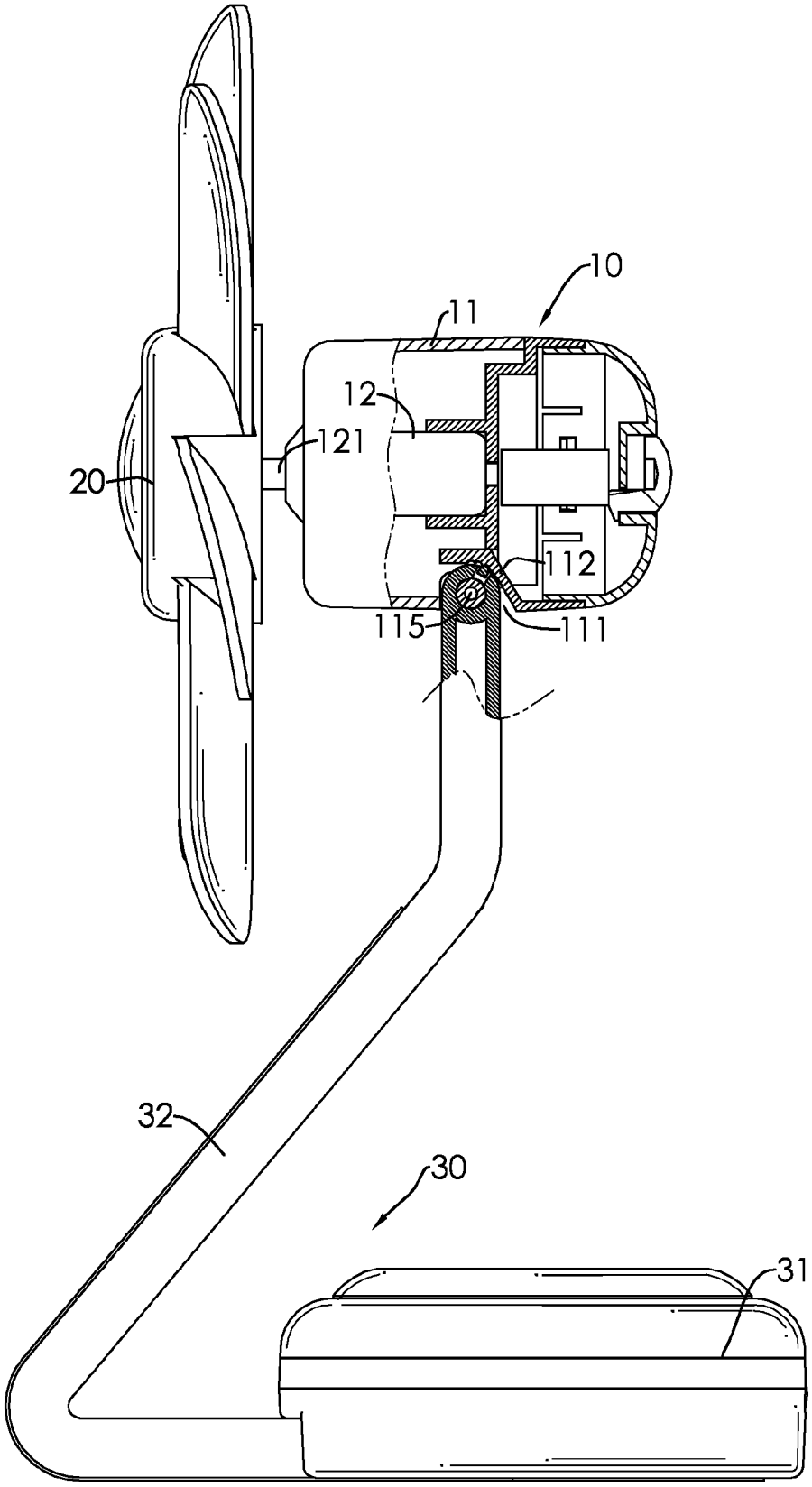
FIG. 1 is a side view in partial section of an electric fan in accordance with the present invention.

With reference to FIG. 1, an electric fan in accordance with the present invention comprises a driving assembly (10), an impeller assembly (20) and a stand (30).

Figure 2:
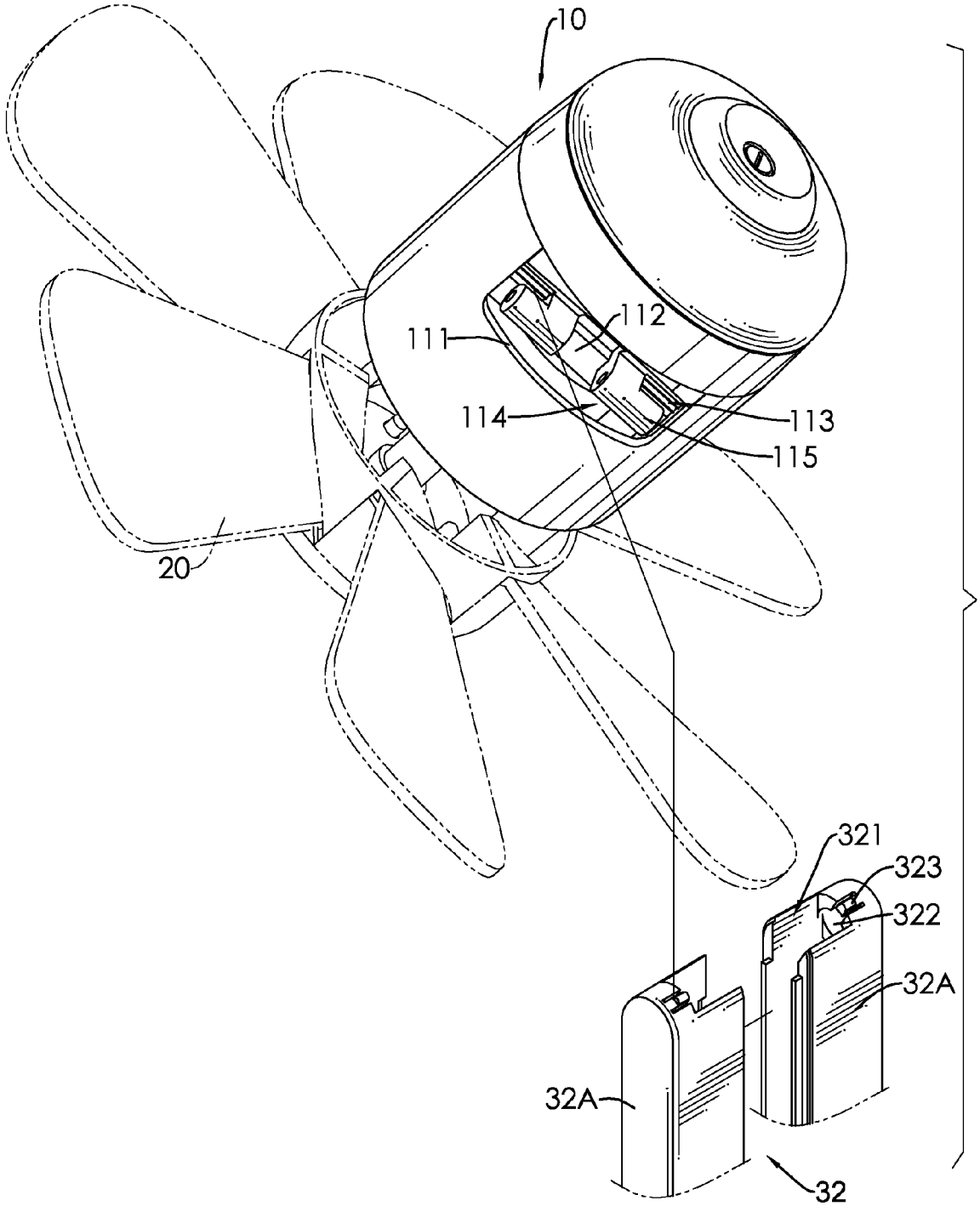
FIG. 2 is an enlarged exploded perspective view of the electric fan in FIG. 1.

With further reference to FIG. 2, the driving assembly (10) has a housing (11) and a motor (12).

The housing (11) has a sidewall, an inner surface, a front end, a through hole (111), a limiting edge, a positioning panel (112) and two connectors (114).

The through hole (111) is formed through the sidewall of the housing (11). The limiting edge is defined around the through hole (111).

The positioning panel (112) protrudes from the inner surface of the housing (11) and has two opposite ends, a positioning surface and multiple indentations (113). The positioning surface of the positioning panel (112) faces the through hole (111) of the housing (11). The indentations (113) is formed transversely in the positioning surface adjacent to the ends of the positioning panel (112).

The connectors (114) are formed on and protrude from the positioning surface of the positioning panel (112) and are respectively adjacent to the indentations (113). Each connector (114) has a mounting shaft (115). The mounting shaft (115) corresponds to and is parallel to the indentations (113) of the positioning panel (112).

The motor (12) is mounted in the housing (11) and has a driving shaft (121). The driving shaft (121) protrudes out from the front end of the housing (11) and has a distal end.

The impeller assembly (20) is mounted securely on the distal end of the driving shaft (121) of the motor (12), is driven by the motor (12) and rotates along with the driving shaft (121).

Figure 3:
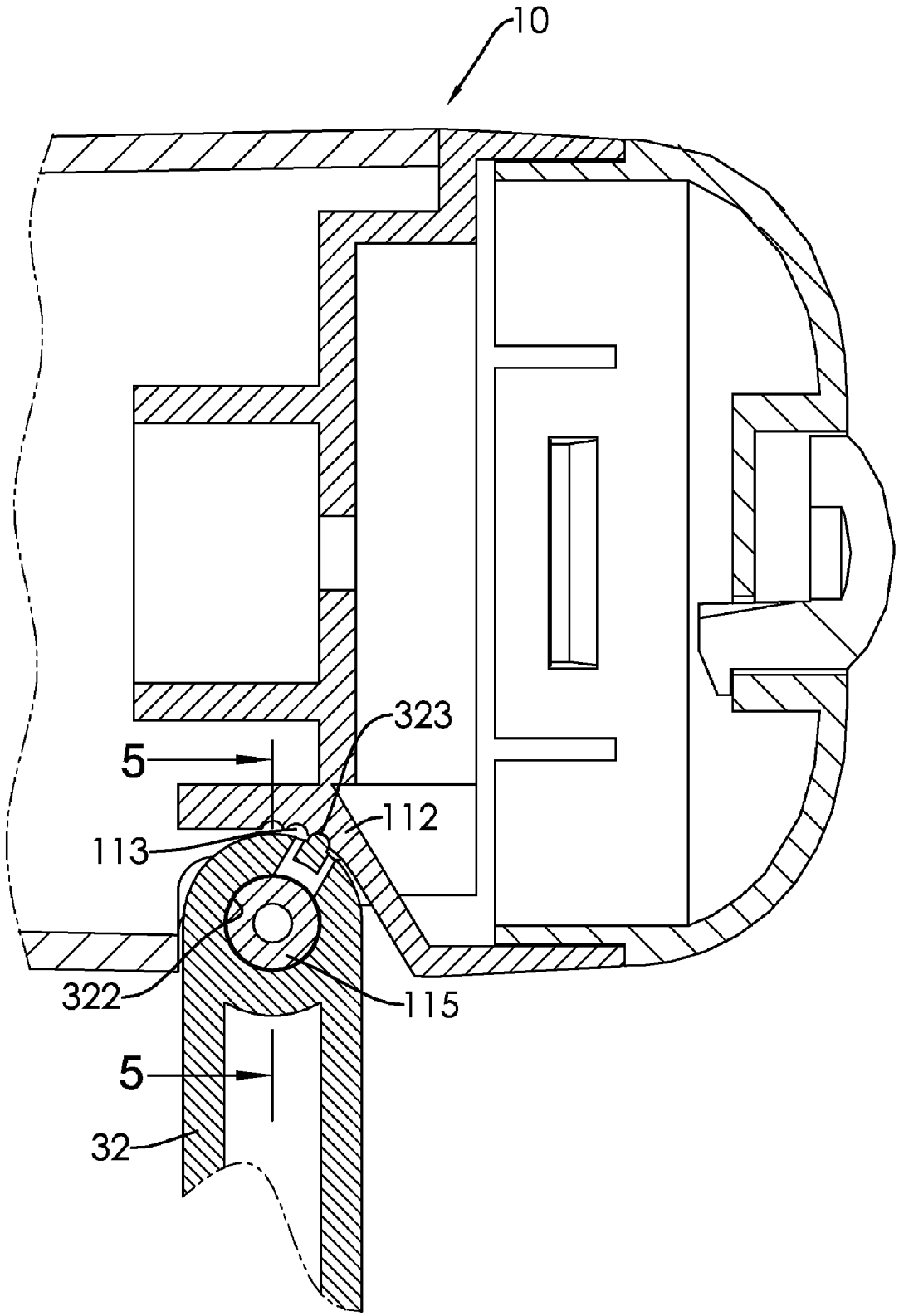
FIG. 3 is an enlarged cross-sectional side view of the electric fan in FIG. 1.
Figure 5:
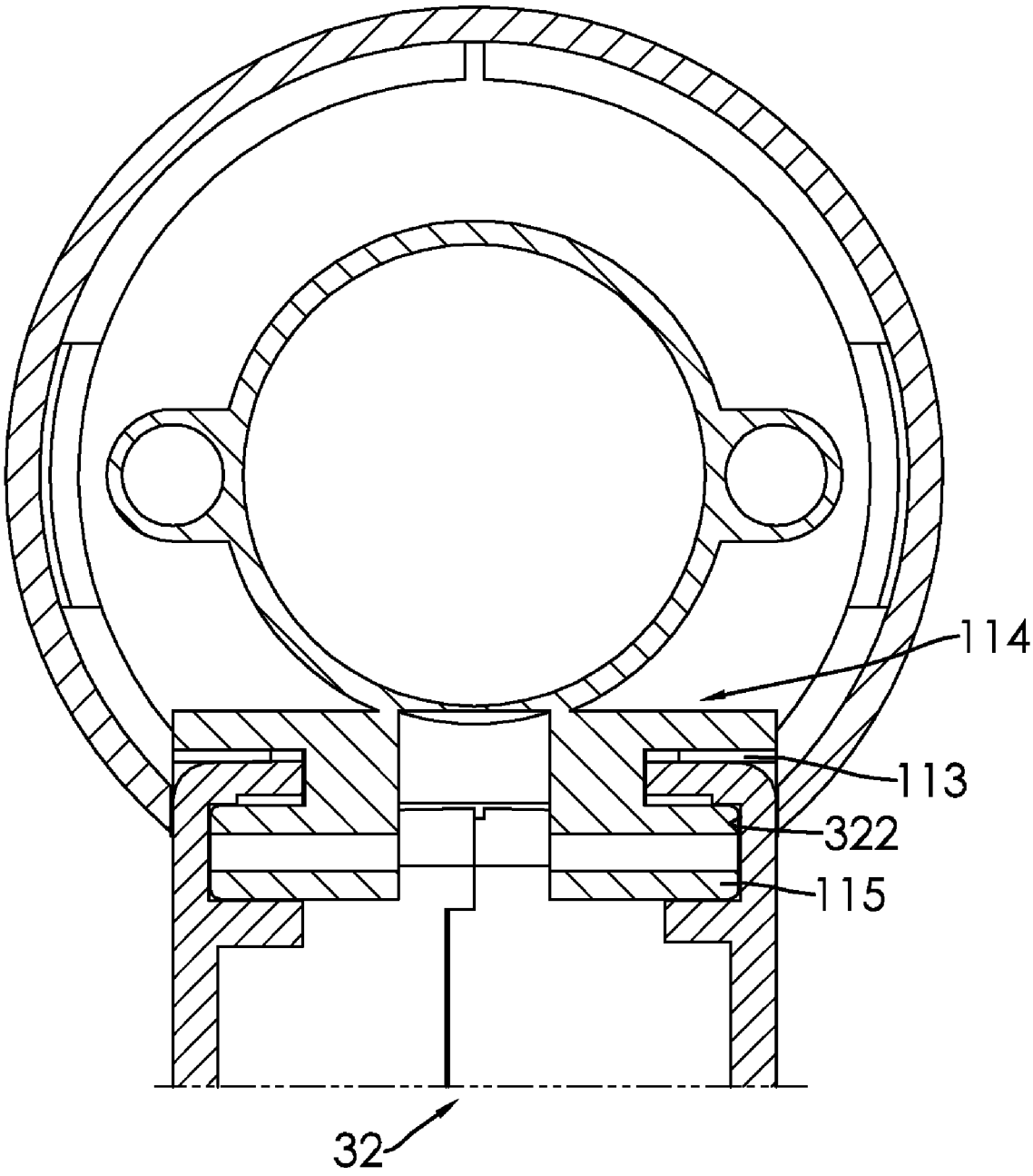
FIG. 5 is a cross-sectional front view of the electric fan along line 5-5 in FIG. 3.

With further reference to FIGS. 3 and 5, the stand (30) is connected to the housing (11) and has a base (31) and an arm (32). The base (31) has a sidewall.

The arm (32) protrudes upward from the base (31), may have two half-shells (32A) being attached to each other and has a bottom end, a middle, a top end, a mounting recess (321), two opposite inner surfaces, two pivot recesses (322) and at least two positioning protrusions (323).

The bottom end protrudes from the sidewall of the base (31). The middle extends obliquely and upwardly from the bottom end of the arm (32). The top end extends from the middle of the arm (32), is mounted through the through hole (111) of the housing (11) and selectively abuts the limiting edge of the housing (11).

The mounting recess (321) is formed in the top end of the arm (32). The pivot recesses (322) are formed respectively in the inner surfaces of the arm (32), align with each other and are mounted respectively around the mounting shafts (115) of the connectors (114) to allow the driving assembly (10) and the impeller assembly (20) to pivot relative to the stand (30). The at least two positioning protrusions (323) are formed on the top end of the arm (32) and are resilient. Each one of the at least two positioning protrusions (323) selectively engages one of the indentations (113) of the positioning panel (112) of the housing (11).

Figure 4:
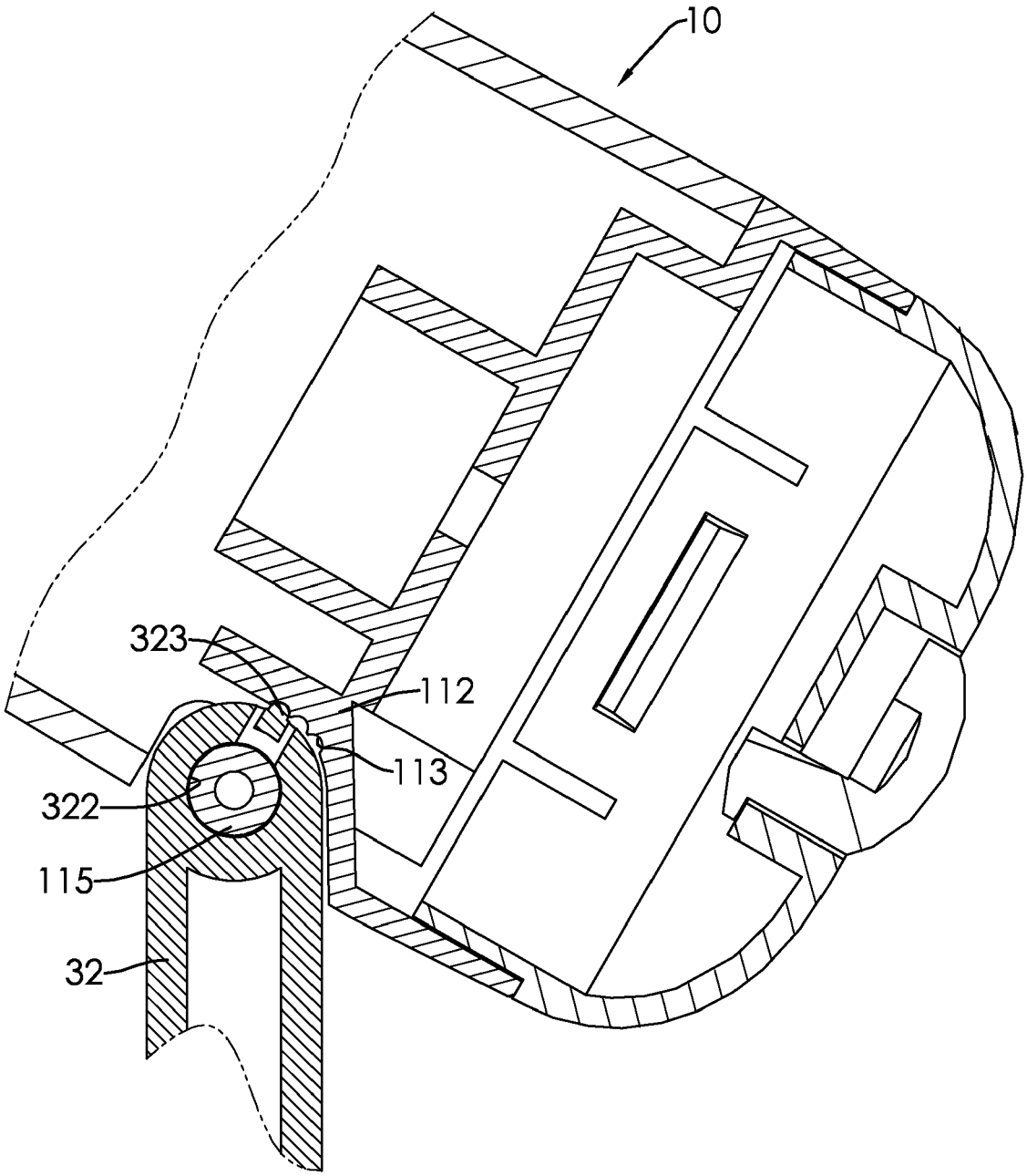
FIG. 4 is an enlarged operational cross-sectional side view of the electric fan in FIG. 1.

With further reference to FIG. 4, the electric fan as described has the following advantage. When the at least two positioning protrusions (323) engage different indentations (113), the driving assembly (10) and the impeller assembly (20) are pivoted and are held in different angles. Therefore, the angle of the impeller assembly (20) is easily adjusted. Moreover, with the arm (32) abutting the limiting edge of the housing (11), a pivot range of the driving assembly (10) is limited.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electric fan comprising:

a driving assembly having a housing having a sidewall;

an inner surface;

a front end;

a through hole being formed through the outer surface of the housing;

a positioning panel protruding from the inner surface of the housing and having two opposite ends;

a positioning surface facing the through hole of the housing; and multiple indentations being formed transversely in the positioning surface adjacent to the ends of the positioning panel; and two connectors being formed on and protruding from the positioning surface of the positioning panel and being respectively adjacent to the indentations, and each connector having a mounting shaft corresponding to and being parallel to the indentations of the positioning panel; and a motor being mounted in the housing and having a driving shaft protruding out from the front end of the housing and having a distal end;

an impeller assembly being mounted securely on the distal end of the driving shaft of the motor; and a stand being connected to the housing and having a base; and an arm protruding upward from the base and having a top end being mounted through the through hole of the housing;

a mounting recess being formed in the top end of the arm;

two opposite inner surfaces;

two pivot recesses being formed respectively in the inner surfaces of the arm, aligning with each other and being mounted respectively around the mounting shafts of the connectors; and at least two positioning protrusions being formed on the top end of the arm and being resilient, and each one of the at least two positioning protrusions selectively engaging one of the indentations of the positioning panel of the housing.

2. The electric fan as claimed in claim 1, wherein the arm of the stand has two half-shells being attached to each other.

3. The electric fan as claimed in claim 1, wherein the base of the stand has a sidewall;

the arm of the stand further has a bottom end protruding from the sidewall of the base; and a middle extending obliquely and upwardly from the bottom end of the arm; and the top end of the arm extending from the middle of the arm.

4. The electric fan as claimed in claim 2, wherein the base of the stand has a sidewall;

the arm of the stand further has a bottom end protruding from the sidewall of the base; and a middle extending obliquely and upwardly from the bottom end of the arm; and the top end of the arm extending from the middle of the arm.

5. The electric fan as claimed in claim 3, wherein the housing of the driving assembly further has a limiting edge being defined around the through hole of the housing; and the top end of the arm selectively abuts the limiting edge of the housing.

6. The electric fan as claimed in claim 4, wherein the housing of the driving assembly further has a limiting edge being defined around the through hole of the housing; and the top end of the arm selectively abuts the limiting edge of the housing.

* * * * *